US006994597B2

(12) United States Patent
Majima

(10) Patent No.: US 6,994,597 B2
(45) Date of Patent: Feb. 7, 2006

(54) CONNECTOR ENABLING SECURE RETENTION OF CONTACTS RELATIVE TO INSULATOR

(75) Inventor: Satoru Majima, Kokubunji (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/691,727

(22) Filed: Oct. 23, 2003

(65) Prior Publication Data

US 2005/0090156 A1 Apr. 28, 2005

(51) Int. Cl.
*H01R 13/514* (2006.01)

(52) U.S. Cl. ..... 439/752; 439/489
(58) Field of Classification Search ..... 439/752, 439/595, 489
See application file for complete search history.

(56) References Cited

U.S. PATENT DOCUMENTS 5,292,261 A * 3/1994 Hirano et al. ..... 439/752

FOREIGN PATENT DOCUMENTS

| | | |
|---|---|---|
| JP | 58-162580 | 10/1983 |
| JP | 4-36784 | 3/1992 |
| JP | 05-144499 | 6/1993 |
| JP | A H07-37639 | 2/1995 |
| JP | 10-083854 | 3/1998 |

* cited by examiner

*Primary Examiner*—Alex Gilman
(74) *Attorney, Agent, or Firm*—Collard & Roe, P.C.

(57) ABSTRACT

A connector includes an insulator having contact receiving portions and a retainer receiving portion that communicate with each other. The connector further includes conductive contacts inserted into the contact receiving portions from a first direction, respectively. The connector further includes a retainer inserted into the retainer receiving portion from the first direction for preventing the contacts from coming off in a direction opposite to the first direction. The retainer includes a body portion and a pair of elastic pieces each elastically deformable and joined to the body portion. The body portion has a pair of excessive deformation preventing portions each for preventing excessive deformation of the corresponding elastic piece toward the body portion. The elastic pieces each have a specific lock portion, and the insulator has a pair of specific lock receiving portions each for locking the corresponding specific lock portion when the retainer is inserted to a predetermined position of the retainer receiving portion.

22 Claims, 3 Drawing Sheets

CONNECTOR ENABLING SECURE RETENTION OF CONTACTS RELATIVE TO INSULATOR

BACKGROUND OF THE INVENTION

The present invention relates to a connector suitable for electrically and mechanically connecting between devices mounted on a vehicle or the like that is subjected to vibration.

JP-A-H07-37639 discloses one example of a connector of this type, wherein the connector comprises an insulator of a box shape, conductive contacts disposed in the insulator, and a retainer for preventing the contacts from coming off the insulator. Each contact is connected to one end portion of a cable and inserted into the insulator. The retainer is inserted into the insulator so as to engage with the contacts and the insulator. As a result, the contacts are securely retained relative to the insulator, and therefore, even if the connector is subjected to vibration, the contacts are prevented from coming off.

However, if the retainer is subjected to unexpected occurrence of disadvantage such as deformation, distortion, or breakage, the power of the retainer for retaining the contacts is lowered. In an extreme case, the retainer loses its retaining power so that the contacts may come off the insulator. There is also possibility that the foregoing disadvantage of the retainer may occur when handling the retainer upon assembling the connector.

SUMMARY OF THE INVENTION

It is therefore an object of the present invention to provide a connector that has been improved to ensure secure retention of contacts relative to an insulator.

It is another object of the present invention to provide a connector that can prevent unexpected excessive deformation or distortion to improve rigidity, that is easy in handling upon operation, and that can improve the retaining power for retaining contacts.

Other objects of the present invention will become clear as the description proceeds.

According to an aspect of the present invention, there is provided a connector which comprises an insulator having a contact receiving portion and a retainer receiving portion that communicate with each other, a conductive contact inserted into the contact receiving portion from a first direction, and a retainer inserted into the retainer receiving portion from the first direction for preventing the contact from coming off in a direction opposite to the first direction, the retainer comprising a body portion and an elastic piece that is elastically deformable and joined to the body portion, the body portion having an excessive deformation preventing portion for preventing excessive deformation of the elastic piece toward the body portion, the elastic piece having a specific lock portion, the insulator having a specific lock receiving portion for locking the specific lock portion when the retainer is inserted to a predetermined position of the retainer receiving portion.

DESCRIPTION OF THE PREFERRED EMBODIMENT

Figure 1:
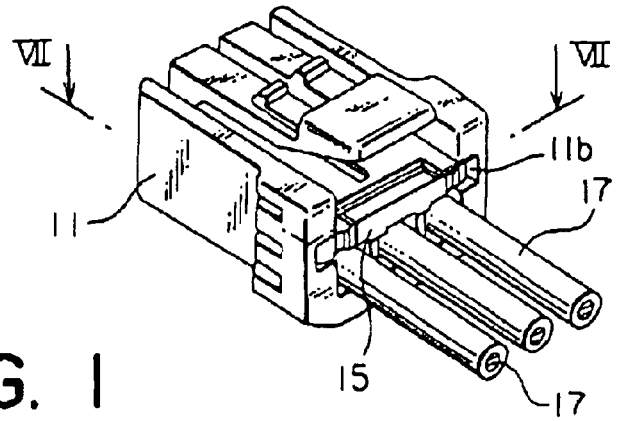
FIG. 1 is a perspective view showing a connector according to a preferred embodiment of the present invention in the state where cables are connected thereto.
Figure 2:
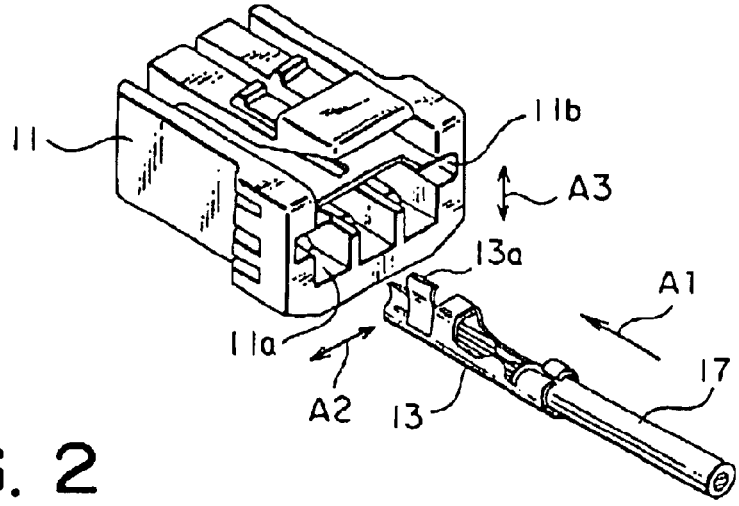
FIG. 2 is a perspective view for explaining a first process of an operation for assembling the connector of FIG. 1.
Figure 3:
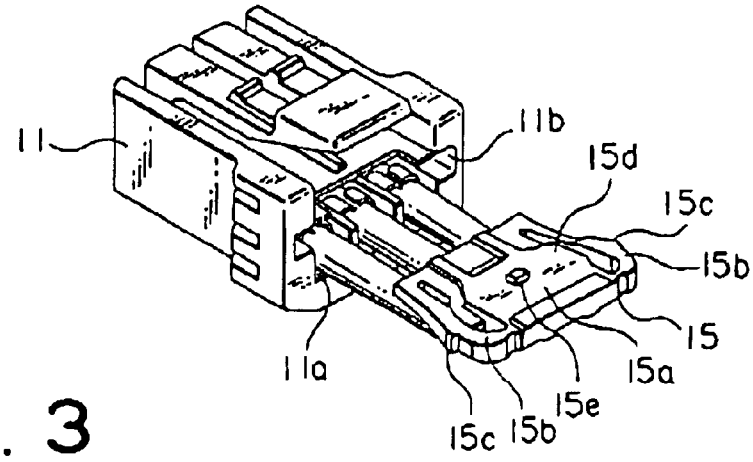
FIG. 3 is a perspective view for explaining a second process of the operation for assembling the connector of FIG. 1.

Referring to FIGS. 1 to 3, description will be given about a connector according to a preferred embodiment of the present invention.

The shown connector comprises a housing or an insulator 11, a plurality of (three in this embodiment) conductive contacts 13 that are inserted into the insulator 11, and a retainer 15 for preventing the contacts 13 from coming off the insulator 11. The insulator 11 is formed with a plurality of (three in this embodiment) contact receiving portions 11*a*, and a retainer receiving portion 11*b* communicating with the contact receiving portions 11*a*. The contact receiving portions 11*a* each extend in a first direction A1, and are arrayed in a second direction A2 perpendicular to the first direction A1. The retainer receiving portion 11*b* is adjacent to the contact receiving portions 11*a* in a third direction A3 perpendicular to the first and second directions A1 and A2.

Each of the contacts 13 is electrically and mechanically connected to one end portion of a cable 17 and inserted into the corresponding contact receiving portion 11*a* from the first direction A1 so as to be retained in the insulator 11. Each contact 13 has a contact portion 13*a* for contact with a counterpart contact of a counterpart connector (not shown).

The retainer 15 serves to prevent the contacts 13 inserted in the insulator 11 from coming off in a direction opposite to the first direction A1. After insertion of the contacts 13, the retainer 15 is inserted into the retainer receiving portion 11*b* of the insulator 11 from the same direction as the contacts 13.

As will be clear from later description, the retainer 15 mounted in the insulator 11 engages with the contacts 13 and the insulator 11 to thereby have the contacts 13 securely retained relative to the insulator 11. Therefore, even if the connector is subjected to vibration, the contacts 13 are prevented from coming off the insulator 11.

Figure 4:
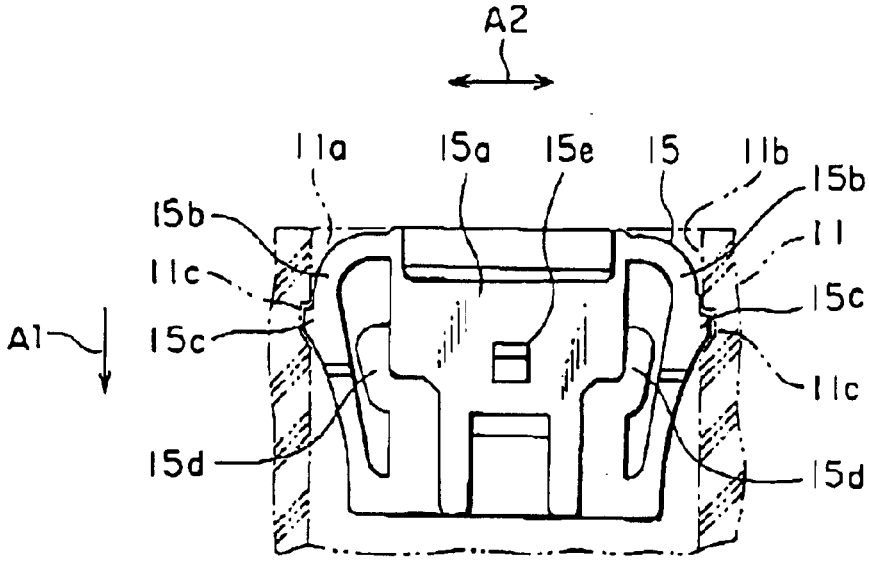
FIG. 4 is a front view of a retainer used in the connector of FIG. 1.
Figure 5:
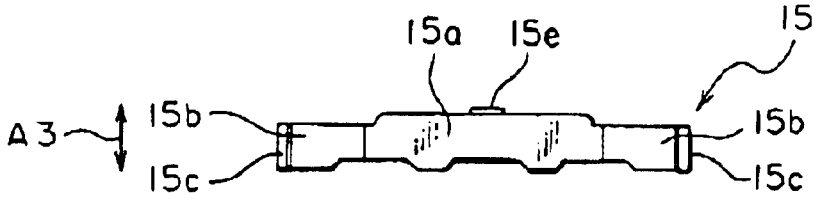
FIG. 5 is a plan view of the retainer used in the connector of FIG. 1.
Figure 6:
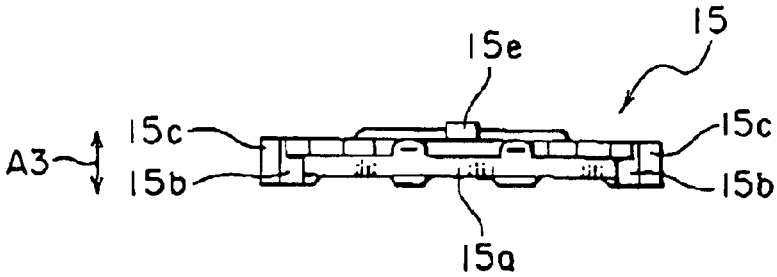
FIG. 6 is a bottom view of the retainer used in the connector of FIG. 1.

Referring to FIGS. 4 to 6, the retainer 15 will be described.

The retainer 15 is a secondary production component that is separate from the insulator 11, and comprises a body portion 15*a* of substantially a plate shape, and a pair of elastic pieces 15*b* on both side surfaces of the body portion 15*a*. Each of the elastic pieces 15*b* has a belt shape extending substantially along the first direction A1, and has its both ends unitarily joined to the side surface of the body portion 15*a*. The body portion 15*a* and the elastic pieces 15*b* may be made of, for example, the same resin material.

Each elastic piece 15*b* can be deformed toward the side surface of the body portion 15*a* and further returned to the initial state in the second directions A2. That is, each elastic piece 15*b* has a spring function. Further, each elastic piece 15*b* is formed with a specific lock portion 15*c* projected outward at an intermediate portion thereof.

The body portion 15*a* is formed on the side surfaces thereof with a pair of excessive deformation preventing portions 15*d* each confronting the elastic piece 15*b* in the second direction A2. Each of the excessive deformation preventing portions 15*d* serves to prevent the corresponding elastic piece 15*b* from being excessively deformed. Further, the body portion 15*a* has one surface in the third direction A3 on which a particular lock portion 15*e* is projected for locking to the insulator 11 within the retainer receiving portion 11*b*.

Figure 7:
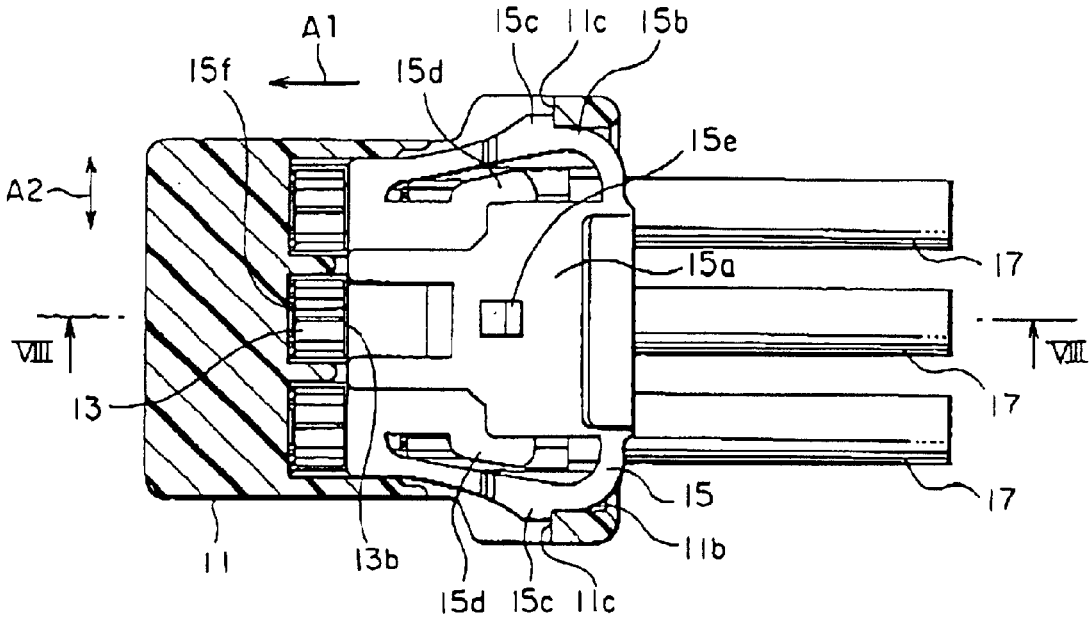
FIG. 7 is an enlarged sectional view taken along a line VII—VII in FIG. 1.
Figure 8:
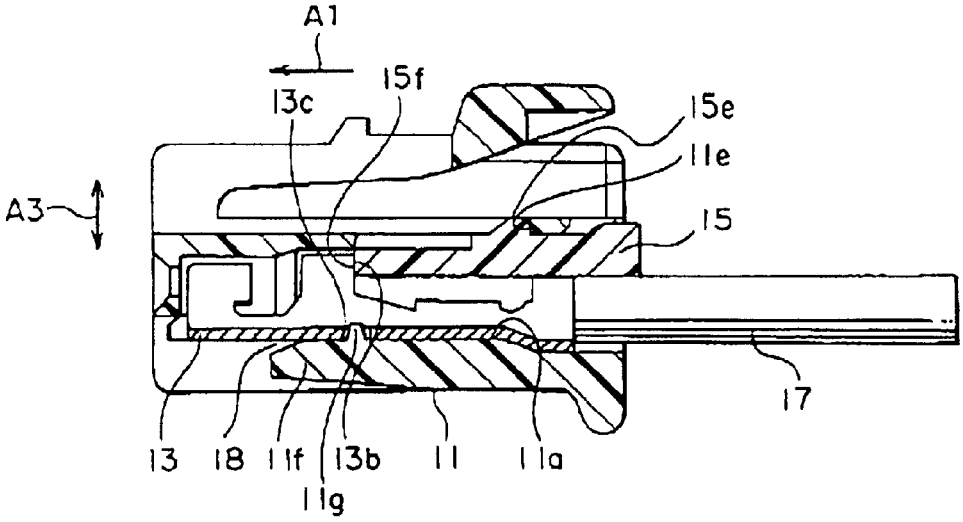
FIG. 8 is a sectional view taken along a line VIII—VIII in FIG. 7.

Referring also to FIGS. 7 and 8, description will be given about a relationship among the insulator 11, the contacts 13, and the retainer 15.

An inner wall surface of the retainer receiving portion 11*b* of the insulator 11 is formed with specific lock receiving portions 11*c* and a particular lock receiving portion 11*e*. Each of the specific lock receiving portions 11*c* is a surface defining a through hole piercing a wall portion of the insulator 11 in the second direction A2 and, when the retainer 15 is inserted to a predetermined position, it locks the corresponding specific lock portion 15*c*. The particular lock receiving portion 11*e* is a surface defining a through hole piercing a wall portion of the insulator 11 in the third direction A3 and, when the retainer 15 is inserted to the predetermined position, it locks the particular lock portion 15*e*.

The insulator 11 has plural deformable portions 11*f* placed adjacent to the contact receiving portions 11*a*, respectively. The deformable portions 11*f* are elastically deformable in the third direction A3. Plural or three protrusions 11*g* are formed integral with the deformable portions 11*f* to protrude towards the contact receiving portions 11*a*, respectively.

The contacts 13 have engaging holes 13*c* which are for receiving therein the protrusions 11*g*, respectively. In a state where the protrusions 11*g* are inserted in the engaging holes 13*c*, the contacts 13 are locked relative to the insulator 11 in the first direction A1 and an opposite direction opposite to the first direction A1.

When the contacts 13 are inserted into the contact receiving portions 11*a*, the protrusions 11*g* are pushed by the contacts 13. As a result, the deformable portions 11*f* are temporally and elastically deformed by the contacts 13 to apart from the contact receiving portions 11*a*. When the protrusions 11*g* are inserted in the engaging holes 13*c*, the deformable portions 11*f* are restored in the original state. Therefore, the contacts 13 are directly locked against the insulator 11 as described above. In this event, a combination of corresponding ones of the protrusions 11*g* and the engaging holes 13*c* will be referred to as a primary lock mechanism for directly locking each of the contacts 13 with said insulator in the first direction A1.

It is possible to release a lock of the primary lock mechanism by inserting an operating jig (not shown) between the contacts 13 and the deformable portions 11*f* through a wedge-shaped gap 13. More particularly, when the operating jig is inserted between the contacts 13 and the deformable portions 11*f*, the protrusions 11*g* are removed from the engaging holes 13*c*. In this connection, the deformable portions 11*f* may be formed integral one another.

Furthermore, the contacts 13 have shoulder portions 13*b* engaging with an insert end 15*f* of the retainer 15 to be thereby locked within the contact receiving portions 11*a*. Therefore, the contacts 13 are prevented by the retainer 15 from being pulled out in the opposite direction that is opposite to the first direction A1. In this event, a combination of each of the shoulder portions 13*b* and the insert end 15*f* will be referred to as a secondary lock mechanism for indirectly locking each of the contacts 13 with the insulator 11 through the retainer 15 in the first direction A1.

Now, description will be given about an operation of assembling the connector of FIG. 1.

At the outset, in a first process of the assembling operation, as shown in FIG. 2, each contact 13 connected with the cable 17 is inserted into the contact receiving portion 11*a* of the insulator 11 from the first direction A1.

Then, in a second process of the assembling operation, as shown in FIG. 3, the retainer 15 is inserted into the retainer receiving portion 11*b* from the first direction A1. When the retainer 15 is inserted into the retainer receiving portion 11*b*, the elastic pieces 15*b* are pressed toward the body portion 15*a* by the inner wall surface of the retainer receiving portion 11*b* to be thereby deformed.

Then, when the retainer 15 is inserted to the predetermined position of the retainer receiving portion 11*b* as shown in FIGS. 1 and 7, the specific lock portions 15*c* enter the specific lock receiving portions 11*c*, and the particular lock portion 15*e* enters the particular lock receiving portion 11*e* so that the retainer 15 is locked within the retainer receiving portion 11*b*. Further, since the shoulder portions 13*b* are engaged with the insert end 15*f* of the retainer 15, the contacts 13 are locked within the contact receiving portions 11*a*. Therefore, the contacts 13 are prevented by the retainer 15 from being pulled out in a direction opposite to the first direction A1.

As described above, the contacts 13 are prevented from coming off, and the secure retention of the contacts 13 is achieved. Further, by means of the contact of each elastic piece 15*b* with the corresponding excessive deformation preventing portion 15*d*, excessive deformation of the elastic piece 15*b* in the deforming direction is prevented upon inserting the retainer 15 to the predetermined position of the retainer receiving portion 11*b*.

The retainer 15 can be removed from the insulator 11. Specifically, the retainer 15 can be detached by pushing the elastic pieces 15*b* toward the side surfaces of the body portion 15*a* using a tool (not shown) or the like in the state shown in FIGS. 7 and 8 to thereby release the locking between the specific lock portions 15*c* and the specific lock receiving portions 11*c*, further releasing the locking between the particular lock portion 15*e* and the particular lock receiving portion 11*e* thereupon, and then pulling out the retainer 15 from the insulator 11. In this event, each elastic piece 15*b* is deformable until it is brought into contact with the corresponding excessive deformation preventing portion 15*d*, and therefore, the lock releasing operation can be carried out while preventing excessive deformation exceeding it.

While the present invention has thus far been described in connection with a single embodiment thereof, it will readily be possible for those skilled in the art to put this invention into practice in various other manners. For example, a recess or a groove can form each of the lock receiving portions.

What is claimed is:

1. A connector comprising:

an insulator having a contact receiving portion and a retainer receiving portion that communicate with each other;

a conductive contact inserted into said contact receiving portion from a first direction; and a retainer inserted into said retainer receiving portion from said first direction for preventing said contact from coming off in a direction opposite to said first direction, said retainer comprising a body portion and an elastic piece that is elastically deformable and joined to said body portion, said body portion having an excessive deformation preventing portion for preventing excessive deformation of said elastic piece toward said body portion, said elastic piece having a specific lock portion and projecting from said body portion in a second direction perpendicular to said first direction, said contact receiving portion and said retainer receiving portion being adjacent to each other in a third direction perpendicular to said first and second directions, said body portion having a particular lock portion projected in said third direction, said elastic piece is pushed and deformed toward said body portion by an inner wall surface of said retainer receiving portion when said retainer is inserted into said retainer receiving portion, and said insulator having a specific lock receiving portion for locking said specific lock portion when said retainer is inserted to a predetermined position of said retainer receiving portion.

2. The connector according to claim 1, wherein said elastic piece extends substantially along said first direction to have an extending end joined to said body portion.

3. The connector according to claim 1, wherein said excessive deformation preventing portion is formed in a position that confronts said elastic piece when said retainer is inserted to the predetermined position of said retainer receiving portion.

4. The connector according to claim 1, wherein said excessive deformation preventing portion is projected from said body portion toward said elastic piece.

5. The connector according to claim 1, wherein said retainer is detachably mounted in said insulator.

6. The connector according to claim 1, wherein said specific lock portion is projected outward from an outer surface of an intermediate portion of said elastic piece, said specific lock receiving portion being defined by a through hole formed on the inner wall surface of said retainer receiving portion.

7. The connector according to claim 1, wherein said specific lock portion is projected outward from an outer surface of an intermediate portion of said elastic piece, said specific lock receiving portion being defined by a through hole formed on the inner wall surface of said retainer receiving portion.

8. The connector according to claim 1, further comprising:

a primary lock mechanism connected to said insulator and said contact for directly locking said contact with said insulator in said first direction; and a secondary lock mechanism connected to said contact and said retainer for indirectly locking said contact with said insulator through said retainer on said first direction.

9. The connector according to claim 8, wherein said retainer has an insert end, said contact having a shoulder portion which engages with said insert end in said first direction, said insert end and said shoulder portion being cooperated with to each other to serve as said secondary lock mechanism.

10. The connector according to claim 8, wherein said primary lock mechanism comprises:

an engaging hole made in said contact; and a protrusion protruding from said insulator towards said contact receiving portion, said protrusion being inserted in said engaging hole to lock said contact in said first direction.

11. The connector according to claim 10, wherein said insulator has a deformable portion elastically deformable, said protrusion being formed integral with said deformable portion.

12. A connector comprising:

an insulator having a contact receiving portion and a retainer receiving portion that communicate with each other;

a conductive contact inserted into said contact receiving portion from a first direction; and a retainer inserted into said retainer receiving portion from said first direction for preventing said contact from coming off in a direction opposite to said first direction, said retainer comprising a body portion and an elastic piece that is elastically deformable and joined to said body portion, said body portion having an excessive deformation preventing portion for preventing excessive deformation of said elastic piece toward said body portion, said excessive formation preventing portion being formed in a position that confronts said elastic piece when said retainer is inserted to the predetermined position of said retainer receiving portion, said elastic piece having a specific lock portion projecting in a second direction perpendicular to said first direction, said contact receiving portion and said retainer receiving portion being adjacent to each other in a third direction perpendicular to said first and second directions, said body portion having a particular lock portion projected in said third direction, said insulator having a particular lock receiving portion for locking said particular lock portion and a specific lock receiving portion for locking said specific lock portion when said retainer is inserted to a predetermined position of said retainer receiving portion.

13. The connector according to claim 12, wherein said elastic piece is projected from said body portion in a second direction perpendicular to said first direction, said elastic piece is pushed and deformed toward said body portion by an inner wall surface of said retainer receiving portion when said retainer is inserted into said retainer receiving portion.

14. The connector according to claim 12, wherein said elastic piece extends substantially along said first direction to have an extending end joined to said body portion.

15. The connector according to claim 12, wherein said excessive deformation preventing portion is projected from said body portion toward said elastic piece.

16. The connector according to claim 12, wherein said retainer is detachably mounted in said insulator.

17. The connector according to claim 12, wherein said specific lock portion is projected outward from an outer surface of an intermediate portion of said elastic piece, said specific lock receiving portion being defined by a through hole formed on the inner wall surface of said retainer receiving portion.

18. The connector according to claim 14, wherein said particular lock receiving portion is defined by a through hole formed in a wall portion of said retainer receiving portion.

19. The connector according to claim 12, wherein said insulator has a deformable portion elastically deformable, said protrusion being formed integral with said deformable portion.

20. The connector according to claim 12, wherein said retainer has an insert end, said contact having a shoulder portion which engages with said insert end in said first direction, said insert end and said shoulder portion cooperating with each other to serve as said secondary lock mechanism.

21. The connector according to claim 12, further comprising:

a primary lock mechanism connected to said insulator and said contact for directly locking said contact with said insulator in said first direction; and a secondary lock mechanism connected to said contact and said retainer for indirectly locking said contact with said insulator through said retainer to said first direction.

22. The connector according to claim 21, wherein said primary lock mechanism comprises:

an engaging hole made in said contact; and a protrusion protruding from said insulator towards said contact receiving portion, said protrusion being inserted in said engaging hole to lock said contact in said first direction.

* * * * *

UNITED STATES PATENT AND TRADEMARK OFFICE

CERTIFICATE OF CORRECTION

PATENT NO. : 6,994,597 B2
APPLICATION NO. : 10/691727
DATED : February 7, 2006
INVENTOR(S) : Majima It is certified that error appears in the above-identified patent and that said Letters Patent is hereby corrected as shown below:

Column 5,
Line 10, after "portion" delete "and".
Line 60, after "retainer" change "on" to -- in --.
Line 65, after "portion" delete "being".
Line 66, change "cooperated with to" to -- cooperating with --.

Column 7,
Line 8, after "retainer" change "to" to -- in --.

Signed and Sealed this

Twentieth Day of June, 2006

JON W. DUDAS
*Director of the United States Patent and Trademark Office*